United States Patent [19]

White

[11] 4,257,431

[45] Mar. 24, 1981

[54] PROCESS FOR EXPANDING TOBACCO

[75] Inventor: Jackie L. White, Pfafftown, N.C.

[73] Assignee: R. J. Reynolds Tobacco Company, Winston-Salem, N.C.

[21] Appl. No.: 959,977

[22] Filed: Nov. 13, 1978

[51] Int. Cl.[3] ..... A24B 3/18

[52] U.S. Cl. ..... 131/140 P

[58] Field of Search ..... 131/140 P, 120, 121, 131/134, 135, 136, 138; 426/443, 445, 450, 449

[56] References Cited

U.S. PATENT DOCUMENTS

| | | | |
|---|---|---|---|
| 3,409,022 | 11/1968 | de la Burde | 131/121 |
| 3,409,027 | 11/1968 | de la Burde | 131/140 P |
| 3,575,178 | 4/1971 | Stewart | 131/140 P |
| 3,771,533 | 11/1973 | Armstrong et al. | 131/140 P |
| 3,837,481 | 9/1974 | Stungis et al. | 131/140 P |
| 4,071,304 | 1/1978 | Chauvin | 426/443 |

FOREIGN PATENT DOCUMENTS

| | | | |
|---|---|---|---|
| 1013640 | 7/1977 | Canada | 131/140 P |
| 725015 | 7/1972 | South Africa | 131/140 P |
| 1375420 | 11/1974 | United Kingdom | 131/140 P |
| 1375820 | 11/1974 | United Kingdom | 131/140 P |
| 1484536 | 9/1977 | United Kingdom | 131/140 P |

*Primary Examiner*—V. Millin

*Attorney, Agent, or Firm*—Herbert J. Bluhm

[57] ABSTRACT

This invention relates to a process for expanding tobacco wherein tobacco impregnated with an expansion agent is rapidly heated in the presence of hot inert solid particles to effect expansion of the tobacco.

13 Claims, No Drawings

PROCESS FOR EXPANDING TOBACCO

BACKGROUND OF THE INVENTION

In recent years a number of processes for expanding tobacco have been disclosed which involve rapidly heating tobacco that has been previously impregnated with an expansion agent. The expansion agents which have been proposed are organic or inorganic materials capable of rapid vaporization, expansive decomposition or other expansion under the heating conditions employed. The rapid formation and/or expansion of vapors or gases emanating from the expansion agent present in the tobacco causes the tobacco particles to expand. Effective expansion of the tobacco is dependent in part on the rate of heating the impregnated tobacco. The rate of heating is, in turn, determined by the impregnant and moisture content of the tobacco, the temperature and heat capacity of the heating medium, the relative quantities or flow rates of the impregnated tobacco and heating medium, and the efficiency of the heat transfer between the heating medium and the impregnated tobacco.

SUMMARY OF THE INVENTION

The present invention relates to improvements in a tobacco expansion process wherein tobacco impregnated with an expansion agent is contacted with hot inert solid particles to effect expansion of the tobacco. Use of the hot inert solid particles results in somewhat greater tobacco expansion than that obtained from prior art processes.

In accordance with one embodiment of this invention, tobacco is impregnated with an expansion agent by contacting the tobacco with the agent, the latter being in the form of a liquid, vapor or solution under the impregnation conditions used. Suitable expansion agents and methods of impregnation are described in the prior art including U.S. Pat. Nos. 3,524,451, 3,524,452, 3,575,178, 3,683,937, 3,693,631 and 3,882,874. Particularly preferred expansion agents are organic compounds which are essentially chemically inert to the tobacco and are capable of rapid vaporization or expansion at the temperatures to which the tobacco is subsequently subjected including, for example, aliphatic hydrocarbons such as butane, pentane, hexane, heptane and the corresponding unsaturated hydrocarbons; aliphatic alcohols, such as methanol, ethanol, propanol and 2-propanol; ketones such as acetone, methyl ethyl ketone and diethyl ketone; cycloaliphatic hydrocarbons such as cyclopentane, cyclohexane and cyclohexene; and halogenated hydrocarbons such as ethyl chloride, methylene chloride, trichloroethylene, trichloromonofluoromethane and trichlorotrifluoroethane.

After the tobacco has been thoroughly impregnated, the impregnated tobacco is contacted with hot inert solid particles to effect expansion of the tobacco. Inert solid particles are defined herein as solid particles of non-tobacco materials which exhibit no significant chemical reactivity toward tobacco or the impregnating agent under the processing conditions used and include beads of ceramic materials, metals, alumina, silica and similar materials which are stable at relatively high temperatures (i.e., melting points above approximately 300° C.). The term "solid particles" as used herein refers to materials other than liquids or gases at the processing temperatures contemplated but does include solid particles which are hollow such as, for example, hollow beads. Also, the inert solid particles should not give rise to undesirable flavor or aroma development in the tobacco under the processing conditions used. It is important that the size and quantity of the solid particles be such that good contact is achieved between the respective surface areas of the particles and the tobacco. Generally speaking, it is preferred that the solid particles have maximum and minimum dimensions between about 0.10 and 5 millimeters, more preferably between about 0.3 and 2 millimeters. The shape of the solid particles or beads is not particularly critical and it may, for example, be spherical or cylindrical. The surface of the particles or beads should be relatively free of projections or protuberances which might interfere with their separation from the expanded tobacco. The quantity of particles or beads necessary will depend on a number of factors including the amount of tobacco to be treated, the manner in which the treatment is carried out and the temperature differential between the particles or beads and the impregnated tobacco. The weight of inert solid particles used should be at least equivalent to the weight of the impregnated tobacco being contacted and, preferably, at least three parts by weight of the particles should be used for each part of impregnated tobacco.

The solid particles or beads are heated by appropriate means such as radiant heat energy, hot gases or contact with a suitable heat exchanging surface. The heated particles or beads should preferably have a temperature between 100° and 300° C. at the time of contact with the impregnated tobacco. Suitable means are also employed for bringing the impregnated tobacco and the particles or beads into contact and for separating the expanded tobacco from the particles or beads following the contacting step. Preferred separating means include a moving gas stream having sufficient velocity to entrain selectively the expanded tobacco. The contact time between the hot inert solid particles and the impregnated tobacco should be such that no significant charring of the tobacco will occur under the processing conditions employed. Generally, the contact time should be no more than about 2 minutes at the lower operating temperatures and shorter contact times are preferred as the temperature of the hot particles is increased. Expansion of the tobacco usually occurs within a short time after the initial contact with the hot solid particles although this time may vary somewhat depending on other factors such as impregnant and moisture content of the tobacco, relative quantities of the impregnated tobacco and heating medium as well as the manner in which the tobacco is contacted with the particles. The degree of expansion achieved can easily be determined by measuring the filling value of the tobacco using techniques known to the art. One such technique is described, for example, in U.S. Pat. No. 3,683,937.

The following examples will serve to further illustrate the advantages of the present invention:

EXAMPLE 1

Approximately 300 grams of cylindrically-shaped aluminum beads measuring 0.75 millimeter in diameter by 0.75 millimeter in length were placed into a glass dish having a 9.5-centimeter diameter to give a bead depth of about 2 centimeters. The beads and dish were heated on a hot plate to a temperature of 190°-200° C. as measured by a thermocouple inserted into the approximate center of the mass of beads. One-gram portions of cut flue-cured tobacco containing 30 percent moisture and impregnated with 2-propanol equivalent to 50 percent by weight based on the dry weight of the tobacco were quickly stirred into the mass of beads. Contact time with the beads was about 21 seconds and the resulting expanded tobacco was separated from the beads by a gentle stream of air. The filling value of the expanded tobacco after moisture equilibration was found to be 22.8 milliliters/3 grams or an increase of 87 percent over the control sample which had a filling value of 12.2 milliliters/3 grams.

EXAMPLE 2

The 2-propanol-impregnated tobacco described in Example 1 was also expanded by subjecting one-gram portions thereof to a stream of heated air having a temperature of 190°-200° C. Exposure time to the heated air was 45 seconds and the stream of heated air was provided by a small portable drier available as catalog No. 20014 from National Scientific of Cleveland, Ohio 44146. The filling value of the expanded tobacco after moisture equilibration was 16.9 milliliters/3 grams or an increase of 38.5 percent over the control sample which had a filling value of 12.2 milliliters/3 grams.

EXAMPLE 3

The 2-propanol-impregnated tobacco described in Example 1 was also expanded by contacting one-gram portions of the impregnated tobacco with a flat metal surface which had been preheated to 190°-200° C. Contact time with the metal surface was 72 seconds. The filling value of the expanded tobacco after moisture equilibration was 15.2 milliliters/3 grams or an increase of 24.6 percent over the control sample which had a filling value of 12.2 milliliters/3 grams.

EXAMPLE 4

The procedure of Example 1 was repeated except that the tobacco was impregnated with pentane and the contact time with the beads was approximately 42 seconds. The filling value of the expanded tobacco after moisture equilibration was 24.9 milliliters/3 grams, an increase of 104 percent over the control sample which had a filling value of 12.2 milliliters/3 grams.

EXAMPLE 5

The procedure of Example 1 was repeated except that the tobacco was impregnated with trichloromonofluoromethane. The filling value of the expanded tobacco after moisture equilibration was 26.9 milliliters/3 grams which represents an increase of 120 percent over the control sample which had a filling value of 12.2 milliliters/3 grams.

EXAMPLE 6

Spherical glass beads ranging in diameter between 1.4 and 2.0 millimeters and weighing a total of 400 grams were placed in a glass dish to give a bead depth of about 1.25 centimeters. The beads and dish were heated on a hot plate to a temperature of about 150° C. and approximately 8 grams of cut flue-cured tobacco containing 30 percent moisture and impregnated with pentane equivalent to 60 percent by weight based on the dry weight of the tobacco were introduced into the mass of beads. The hot beads and impregnated tobacco were rapidly mixed together for about 20 seconds and the tobacco was then separated from the beads by a gentle stream of air. The filling value for the expanded tobacco after moisture equilibration was found to be 20.1 milliliters/3 grams or an increase of 69 percent over the control sample which had a filling value of 11.9 milliliters/3 grams.

While particular embodiments of the present invention have been described in the foregoing, it is apparent that any number of other modifications may be made without departing from the spirit and scope of the appended claims.

What is claimed is:

1. A process for expanding tobacco impregnated with an expansion agent which comprises contacting the impregnated tobacco with a quantity of hot inert solid particles for a time sufficient to effect rapid vaporization or expansion of said expansion agent with concomitant expansion of the tobacco and separating the expanded tobacco from said particles.

2. The process of claim 1 in which said particles have maximum and minimum dimensions between 0.10 and 5 millimeters.

3. The process of claim 1 in which the particles have a temperature between 100° and 300° C. at the time of contact with the impregnated tobacco.

4. The process of claim 1 in which said particles are metal beads.

5. The process of claim 3 in which the expansion agent in the impregnated tobacco comprises an organic compound capable of rapid vaporization under the contacting conditions employed.

6. The process of claim 5 in which the organic compound is an aliphatic alcohol.

7. The process of claim 5 in which the organic compound is a hydrocarbon.

8. The process of claim 5 in which the organic compound is a halogenated hydrocarbon.

9. A process for treating tobacco in which the tobacco is impregnated with an expansion agent and the resulting impregnated tobacco is rapidly heated to effect rapid vaporization or expansion of said expansion agent with concomitant expansion of the tobacco characterized by the fact that the impregnated tobacco is rapidly heated by contacting with a quantity of hot inert solid particles for a period of time less than two minutes and the expanded tobacco is separated from the inert solid particles by a moving gas stream.

10. The process of claim 9 in which said particles have maximum and minimum dimensions between 0.10 and 5 millimeters.

11. The process of claim 9 in which said particles have a temperature between 100° and 300° C. at the time of contact with the impregnated tobacco.

12. The process of claim 9 in which said particles are metal beads.

13. The process of claim 9 in which the weight of said quantity of hot inert solid particles is at least equivalent to the weight of said impregnated tobacco.

* * * * *